US005280700A

United States Patent [19]

Haase et al.

[11] Patent Number: 5,280,700

[45] Date of Patent: Jan. 25, 1994

[54] COVER OF A SPINBOX OF A ROTOR SPINNING MACHINE

[75] Inventors: Manfred Haase, Ingolstadt; Josef Schermer, Unterstall; Dieter Fritsch, Wackerstein, all of Fed. Rep. of Germany

[73] Assignee: Rieter Ingolstadt Spinnereimaschinenbau AG, Ingolstadt, Fed. Rep. of Germany

[21] Appl. No.: 949,680

[22] Filed: Sep. 22, 1992

[30] Foreign Application Priority Data

Sep. 23, 1991 [DE] Fed. Rep. of Germany ..... 4131665

[51] Int. Cl.[5] ..... D01H 4/24; D01H 11/00

[52] U.S. Cl. ..... 57/406; 57/302; 57/415

[58] Field of Search ..... 57/404, 406, 407, 411, 57/413, 415, 302

[56] References Cited

U.S. PATENT DOCUMENTS

| | | | |
|---|---|---|---|
| 3,651,632 | 3/1972 | Shepherd | 57/404 |
| 3,760,577 | 9/1973 | Kihara et al. | 57/415 X |
| 4,022,011 | 5/1977 | Hirai | 57/302 X |
| 4,070,813 | 1/1978 | Quandt et al. | 57/406 X |
| 4,122,655 | 10/1978 | Anderson et al. | 57/407 |
| 4,211,063 | 7/1980 | Bock et al. | 57/302 |
| 4,265,083 | 5/1981 | Braun et al. | 57/302 X |
| 4,291,528 | 9/1981 | Miyamoto et al. | 57/406 |
| 4,769,984 | 9/1988 | Raasch et al. | 57/413 X |
| 4,854,119 | 8/1989 | Stahlecker et al. | 57/406 X |
| 4,893,462 | 1/1990 | Braun et al. | 57/302 |

FOREIGN PATENT DOCUMENTS 2811960 9/1979 Fed. Rep. of Germany .

*Primary Examiner*—Joseph J. Hail, III

*Attorney, Agent, or Firm*—Dority & Manning

[57] ABSTRACT

A rotor cover designed with a sealing surface interacting with a compressed-air connection, whereby the compressed-air connection is effected via a connecting piece located between the rotor cover and the appertaining mounting plate.

30 Claims, 5 Drawing Sheets

6-6

COVER OF A SPINBOX OF A ROTOR SPINNING MACHINE

BACKGROUND OF THE INVENTION

The invention relates to a cover of the spinbox of a rotor spinning machine. It also relates to a mounting plate for the attachment of the cover.

A cover of this type is known from the rotor spinning machine RU 14 of Schubert & Salzer, Maschinenfabrik Aktiengesellschaft, Ingolstadt, Federal Republic of Germany. Such covers, which are called rotor covers for short in the jargon used by specialists in the field, constitute part of the wall of the spinbox in which the spinning rotor rotates. Since the spinbox must be subjected to negative pressure during the formation of yarn it is closed and is usually subjected to active suction. The spinbox must be opened for maintenance of the rotor, e.g. for mechanical cleaning of the rotor and sometimes also for pneumatic rotor cleaning. This also applies when the rotor is to be replaced. The spinbox is opened by opening the cover which constitutes the rotor box or spinbox wall across from the open side of the spinning rotor.

For this purpose the cover is attached to a mounting plate which, in turn, constitutes the cover of the rotor box and is attached to the machine frame, for example, so as to be capable of pivoting in relation to the rotor. Such a rotor box is shown in German Patent Publication No. DE-OS 28 11 960, for example. Among other things, FIG. 2 of this publication shows a cover bearing the reference number 36. For the sake of simplification the mounting plate was omitted in this drawing. In the state of the art it is installed on the side of the cover away from the spinning rotor and, in turn, attached to the cover which is cover 32 in the drawings of No. DE-OS 28 11 960. As can be seen in the drawings of No. DE-OS 28 11 960, the cover not only serves to cover the rotor box but in addition contains a channel to feed fibers into the rotor. Bores for the arrival of cleaning air into the rotor as well as a bore to draw the yarn produced in the rotor out of the rotor box are also contained in the cover.

In a manner not shown in the schematic representation in the publication, the cover has a threaded bore in its back away from the rotor for connection of compressed air for rotor cleaning and a bore into which a yarn draw-off pipe is inserted from the back. It is connected to the cover by a stud screw running at a right angle to the bore.

The known rotor cover consists of an aluminum pressure-cast element that must be machined after casting. Especially threads for compressed-air connection and for the attachment of the yarn draw-off pipe must be installed and this causes an additional machining outlay. The known rotor cover forms a component on the rotor spinning machine which must be replaced from time to time by the operator of the machine. When the machine is changed over to a different yarn which is produced with a rotor of different diameter, the rotor cover must be replaced. The disadvantage of the known cover is that it is difficult to install and to remove. Due to the fact that the compressed-air circuit is connected by means of threads, the compressed-air circuit must first be removed in order to replace the cover and must be re-connected to the new cover to be installed, requiring the use of tools. The yarn draw-off pipe is also removed from the machine together with the removal of the rotor cover since it is firmly connected to the cover. As a result it must be removed from the disassembled cover and replacement of the yarn draw-off pipe, which is a wear part of the rotor spinning machine, is not possible without disassembly the cover.

The known mounting plate to which the cover is attached is provided with a contact surface upon which the rotor cover bears, as well as a threaded bore to screw on the rotor cover. Near the cover's air connection and yarn draw-off pipe the mounting plate is provided with a recess so that when the fastening screw of the cover is loosened, it may be removed together with the air connection and the yarn draw-off pipe. Air connections and yarn draw-off pipes remain firmly connected to the cover and must be removed from it later. This is awkward because of the lack of space and is time consuming. The installation of a new cover is accordingly complicated.

SUMMARY OF THE INVENTION

It is the object of the instant invention to design a cover for the spin box of a rotor spinning machine in such manner that it may be manufactured at low cost and with minimal outlay for strengthening and may be easily replaced.

It is a further object to design a mounting plate for a cover in such manner that when the rotor cover is removed from the mounting plate, it is also separated at the same time from air connection or yarn draw-off pipe or from both.

The design of the fitting for the connection of compressed air with a sealing surface considerably simplifies the machining of the rotor cover. It is no longer necessary to install threads. Providing a sealing surface makes it possible for the cover to be connected with a connecting piece of the compressed-air circuit for rotor cleaning without any further measures being required on the cover. The connection of the compressed-air circuit can be effected by a connecting piece which is applied with a seal against the sealing surface of the fitting. By providing a centering fitting with a centering bore on the back of the cover it is possible to center and align the cover easily when installing it on the mounting plate. By designing the centering system as a bore the machining of the centering fitting is rendered very easy since this point of the cover must, in any case, be provided with a bore which is used to draw the yarn out of the spinning rotor. It is especially advantageous if the centering fitting and the connection of compressed air are given a common plane surface which can be machined in a single operation. By making the centering bore in the form of an offset bore it is possible to center the cover over the wider diameter of the bore while at the same time the yarn draw-off pipe in the rotor cover can be positioned over the smaller diameter.

In an especially advantageous embodiment of the invention, the distance between the sealing surface and the plane formed by the stops with which the cover presses against the mounting plate is sufficiently great so that a connecting piece for the compressed-air circuit can be provided between the cover and the mounting plate. In this manner it is possible to seal off the cover easily against the compressed-air circuit, as the connecting piece can easily be equipped with a seal. It is also possible to make the sealing surface of the cover without seal. For reasons of economy it is possible to integrate the seal into the connecting piece of the compressed-air circuit as the latter is, therefore, needed only once per spinning station. Another advantage is achieved by providing sufficient space between the cover and the connecting plate for the compressed-air circuit to be attached to the mounting plate. It is especially advantageous here to provide a distance from 3 mm to 7 mm. This ensures that the connecting piece of the compressed-air supply can be made sufficiently stable. Furthermore, this ensures that the seal can be sufficiently deformed to provide reliable sealing. It is especially advantageous for the stops on the back of the cover to be cylindrical. They are, thus, easy to produce by casting and provide a sufficiently large bearing surface of the cover upon the appertaining mounting plate. It is especially advantageous for the cylindrical stops to be provided with bores through which screws can be inserted to attach the cover to the mounting plate.

In another advantageous embodiment the stops are made in the form of ridges. These may be a part of the cover edge and ensure that the cover does not tilt on its contact surface. Other advantageous embodiments of the cover according to the invention are described hereinafter.

The inventive design of the mounting plate receiving a cover of a spinbox makes it possible for the connecting circuit of the compressed-air supply of the cover to remain in the mounting plate when the cover is removed. Additional disassembly of the air connection on the cover can thus be omitted. This makes it possible to remove the cover from the mounting plate without great effort and to replace it by a new one. Thanks to the fact that the connecting piece is provided with a seal, the cover can interact sealingly with the connecting piece through a surface that is easy to machine. Integration of a seal into the cover, which would be very costly, is thus not necessary. Thanks to the fact that the connecting piece is attached in the mounting plate it does not change its position when the cover is removed. A rotor cover to be installed can be easily positioned because the mounting plate is provided with a centering bushing. When replacing a cover the latter need no longer be positioned anew in relation to the rotor box and the rotor box. It is especially advantageous for the centering bushing to be provided with a bore into which the yarn drawoff pipe is inserted. This makes it possible to simplify the construction of the rotor cover considerably.

It is no longer necessary to attach the yarn draw-off pipe to the rotor cover if the mounting plate is provided with a seat for the yarn draw-off pipe according to another embodiment of the invention. The yarn draw-off pipe is attached to the mounting plate itself, and the rotor cover can, therefore, be replaced without having to disassemble the yarn draw-off pipe. The reverse is also possible. The seat ensures in any case that the yarn draw-off plate is held by the mounting plate. The positioning within the cover can also be carried out by means of a cover guide. Due to the fact that the seat is designed so that the yarn draw-off pipe is inserted on the side, away from the cover, the yarn draw-off pipe can be replaced without having to remove the cover for that purpose. Additional advantageous embodiments of the invention are described hereinafter.

BRIEF DESCRIPTION OF THE DRAWINGS

The invention is described below through the drawings, in which.

DETAILED DESCRIPTION OF THE INVENTION

Figure 1:
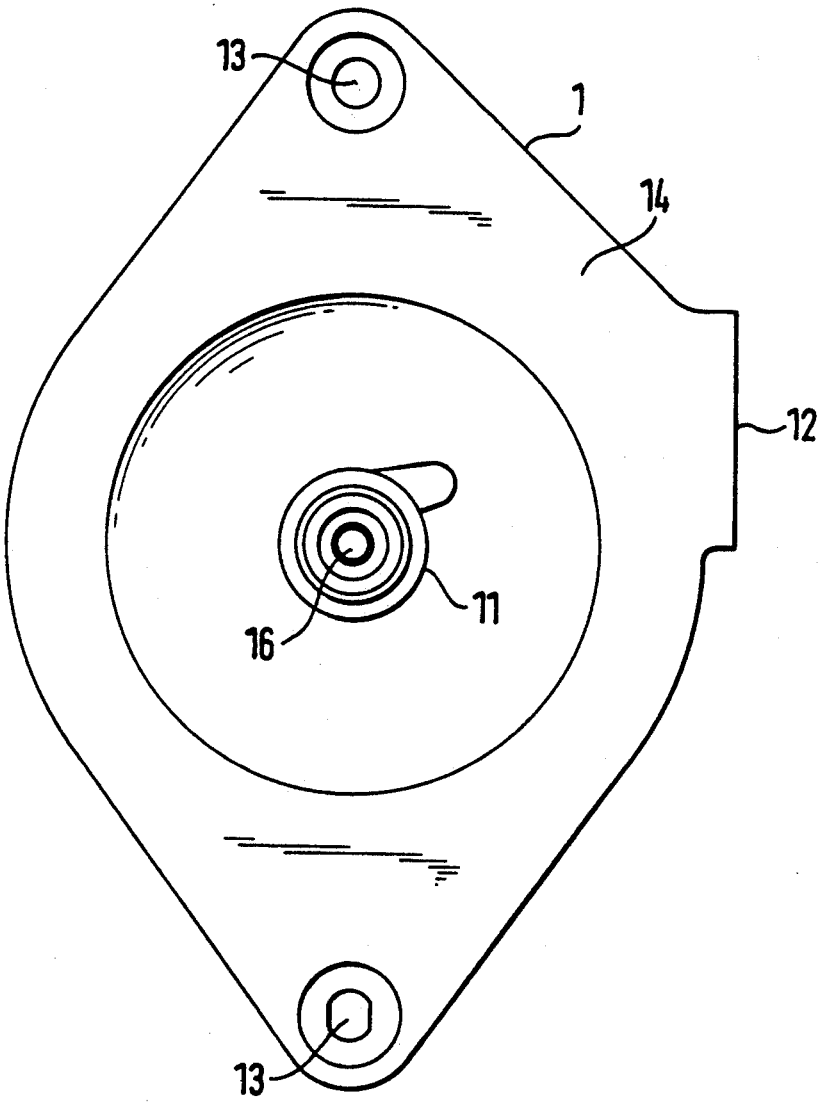
FIG. 1 is a front view of the rotor cover of the invention.

In FIG. 1 the rotor cover 1 is shown in a front view. This is the side which faces the open end of the spinning rotor when the rotor box is closed. At the center of the cover 1 is the fiber feeding fitting 11 and the beginning of a fiber feeding channel 12 can be recognized on the side of the cover 1. In rotor spinning machines a mixture of fibers and air is blown into the rotor in a known manner through such a fiber feeding channel. The cover 1 is provided with two bores 13 through which the cover is attached in a conventional manner to a mounting plate by means of screws. The cover 1 closes off the spinbox against the outside with its forward side 14. The cover 1 is made in the form of a pressure-cast aluminum part and is polished on its forward side 14.

Figure 2:
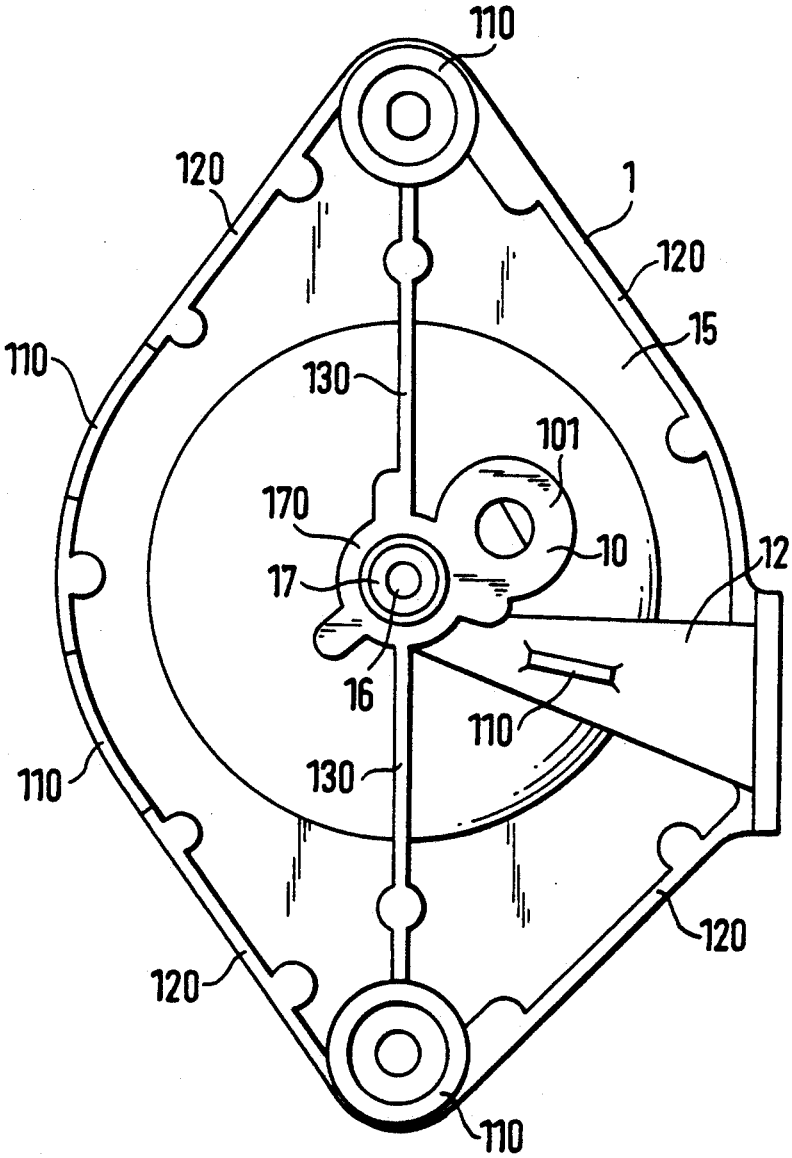
FIG. 2 is a rear view of the rotor cover.

FIG. 2 shows the cover of FIG. 1 from the back side. The cover 1 is essentially flat so that the integrally cast fiber feeding channel 12 emerges from the surface of cover Cover 1 is provided with a fitting 10 on its back side 15 for the connection of compressed air pipe which is used in a known manner to clean the rotor. For this purpose, one or more bores are provided on the inside of the cover, starting from fitting 10, and emerging laterally from the fiber feeding fitting and letting out in the direction of the rotor wall (not seen). A bore 16 can be seen at the center of cover 1, through which the yarn formed in the rotor is drawn off via fiber feeding fitting 11. For this purpose the cover is provided with a yarn draw-off nozzle (not shown) on the fiber feeding fitting 11. On the back side 15 of cover I the bore 16 surrounds a fiber feeding pipe 20 as shown in FIG. 4.

The back side of cover 1 is provided with several stops 110 by means of which the cover bears upon the mounting plate. The stops 110 constitute a plane with which they bear upon the plane of the mounting plate 30 as shown in FIG. 4. In addition edge 120 and reinforcement ridges 130 can be seen on the back of the cover in FIG. 2. Bore 16 for the withdrawal of the yarn from the rotor widens in direction of the back side 15 of the cover, constituting the centering bore 17 for the centering of cover 1 on the mounting plate 30. The centering bore 17 is sunk into a centering fitting 170 which is integrally cast on the back side 15 of cover 1.

Figure 4:
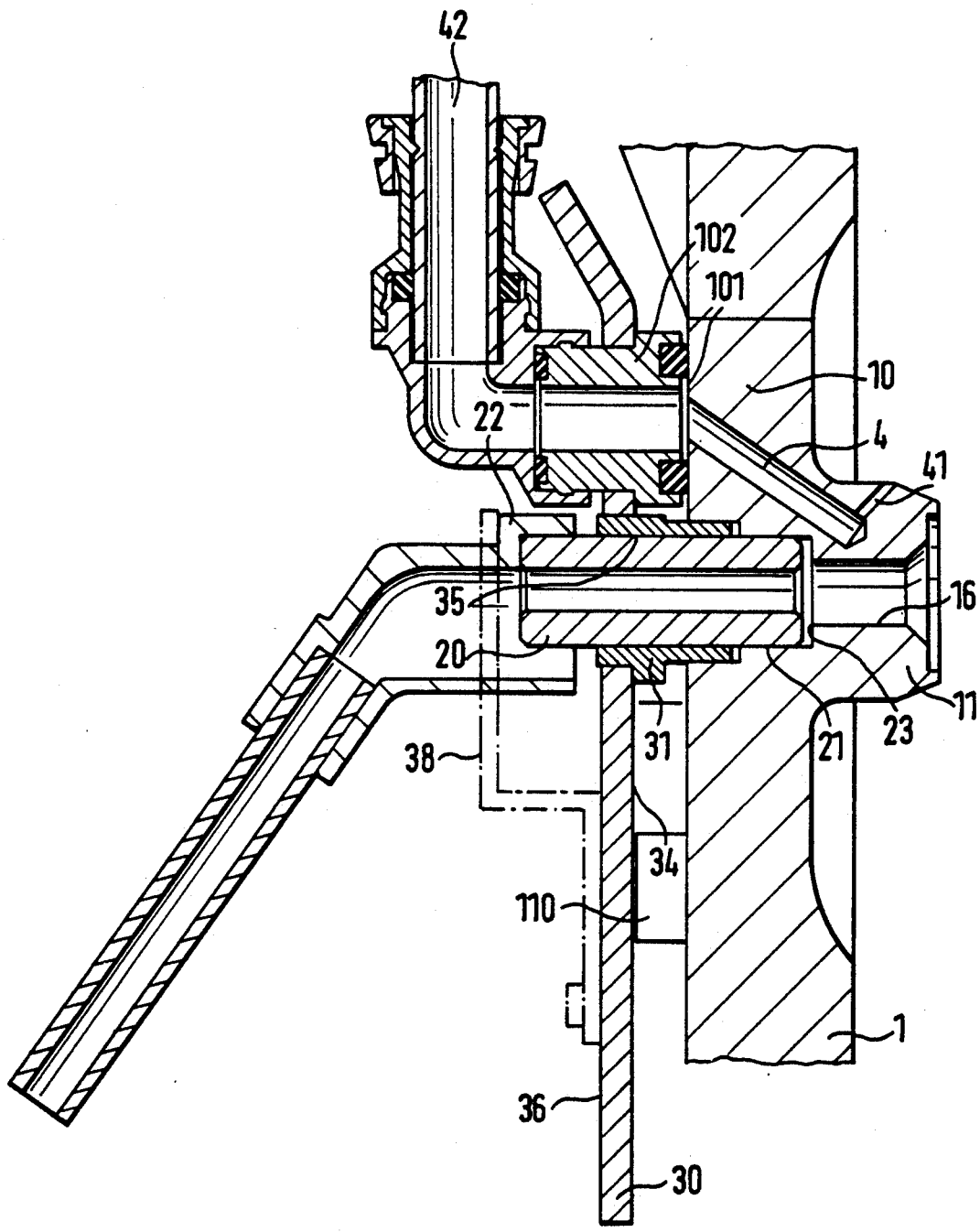
FIG. 4 is a partly sectional view of the rotor cover mounted on a mounting plate according to the invention.

Fitting 10 for the connection of compressed air for rotor cleaning is provided with a plane sealing surface 101 which sealingly interacts with a connecting piece 102 as shown in FIG. 4. The edge 120, the ribs 130 and the surface of the centering fitting 170 towards a viewer of FIG. 2 as well as the sealing surface 101 all constitute a plane together. This is especially advantageous for the machining of the cover since all these parts can be machined in one operation. Together, the stops 110 constitute a plane which is further away from the front of the cover 1 than the plane which is characterized by fitting 10 for the connection of compressed air.

Figure 3:
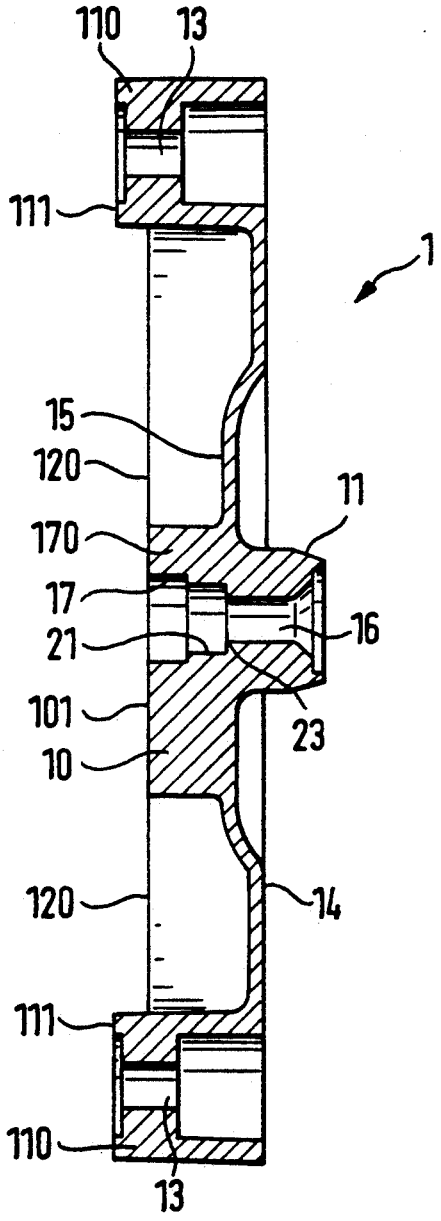
FIG. 3 is a sectional view through a rotor cover.

FIG. 3 is a sectional view through the cover. The fiber feeding fitting 11 is installed at the front side 14. The fiber feeding fitting 11 is provided with a bore 16 for drawing off the yarn from the spinning rotor. The fiber feeding fitting 11, integrally cast to the cover 1 as shown in FIG. 2, has been omitted for the sake of clarity. The fiber feeding fitting 11 merges into the centering fitting 170 at the back 15 of cover 1. Fitting 10 for the connection of compressed air is also located on the back side. Fitting 10 and centering fitting 170, as well as edge 120, are located in one plane so that they can be machined in one operation. For the application of the cover against the mounting plate it is provided with stops 110 which are in form of cylindrical integrally cast parts at the back side 15 of cover 1. They are provided with a bore 13 which is offset so that the cover 1 can be screwed to the mounting plate with hexagon socket screws.

The stops 110 form a plane 111 by which bears upon the mounting plate 30. Plane 111 is parallel with the plane constituted by the sealing surface 101 of fitting 10 for the connection of compressed air. A distance separates the two planes so that a connecting piece 102 can fit between the mounting plate 30 and the back of the cover at the fitting 10 as FIG. 4 shows in greater detail. The centering fitting 170 is provided with a centering bore 17 by which cover 1, centered with a centering bushing 31 (see FIG. 6), can be attached to the mounting plate. The centering bore 17 merges into a bore 21 with a smaller diameter which receives the yarn draw-off pipe 20 (see FIG. 4). As shown in FIG. 2, the stops 110 at the edge 120 have been omitted in FIG. 3 for the sake of simplification. It is, however, also possible to design the cover 1 only with the stops 110 which are cylindrical. The stops 110 need not absolutely be made in one piece with the cover 1. It is also possible to form the stops 110 with shim disks, for instance, between cover 1 and mounting plate 30. It is an essential feature of the invention that when the cover 1 is mounted on the mounting plate 30, a distance should exist between the plane 111 which is then formed by the shim disks and the plane formed by the surface 101. For the sake of clarity the plate 30 shown in a section in FIG. 4 is not shown in FIG. 3.

Figure 5:
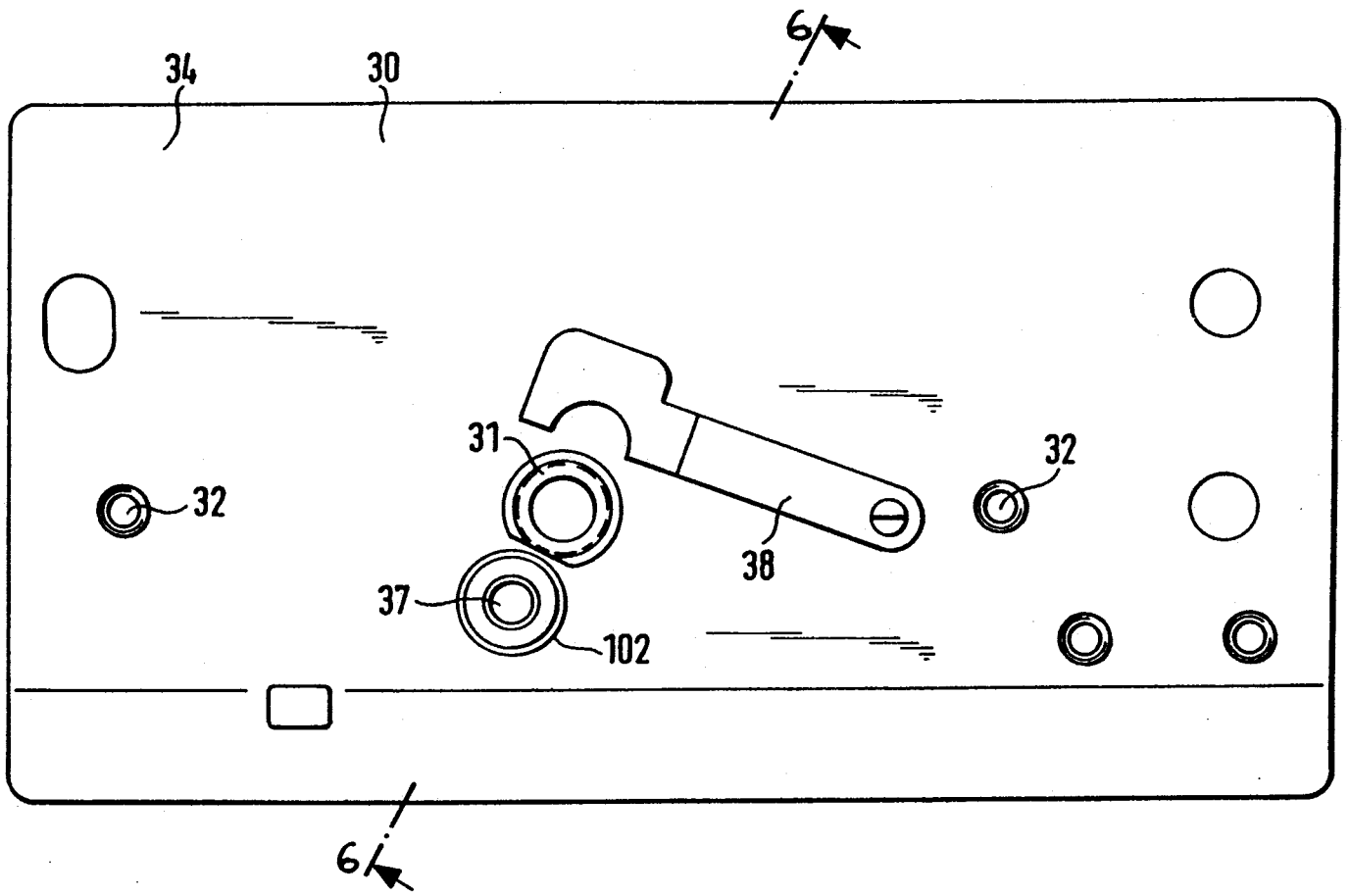
FIG. 5 is a view of the mounting plate.

FIG. 5 shows a mounting plate 30 designed according to the invention. It is provided with two bores 32 through which the cover is screwed to the mounting plate 30. The centering bushing 31 is located between the bores 32. The connecting piece 102 is positioned next to it. The mounting plate 30 is, in turn, attached to the cover of the rotor box through bores 32. The holding device 38 serves to hold the yarn draw-off pipe as shown in FIG. 4.

Figure 6:
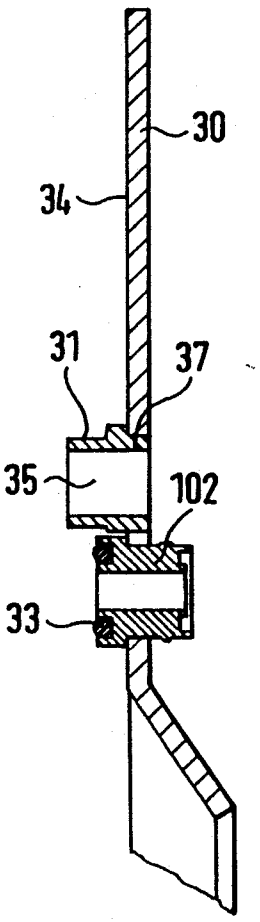
FIG. 6 is a sectional view, taken along line A—A through the mounting plate of FIG. 5.

FIG. 6 shows a section A—A through cover 30 of FIG. 5. The centering bushing 31 is attached in a bore of the mounting plate 30 by welding it in or by shrinking it in. The connecting piece 102 is also seated in a bore of the mounting plate 30 and is designed so that it is held in it at least so that will not fall out when the cover 1 is being disassembled. When assembled it bears with seal 33 against the sealing surface 101 of fitting 10 of cover 1. The seal 33 is then deformed so that secure tightness is ensured. On the side away from the mounting side 34 of the mounting plate the connecting piece 102 is connected to a compressed-air circuit (not shown). The centering bushing 31 is provided with a bore through which a yarn draw-off pipe 20 is inserted as shown in FIG. 4 from the side of mounting plate 30 away from the mounting side 34, extending, in turn, into bore 21 of cover 1 (see FIGS. 3 and 4).

FIG. 4 shows a partial view of a mounting plate 30 upon which a partially shown cover 1 bears. A channel 4 for the passage of compressed air for rotor cleaning through the cover 1 is shown in the fiber feeding fitting 11 and in fitting 10. Channel 4 lets out into a nozzle 41. The cover 1 bears with one stop 110 upon the mounting plate 30. The connecting piece 102 is installed between the sealing surface 101 of the fitting 10 and the mounting side 34 of mounting plate 30. It only extends through the mounting plate 30 on its back side where a compressed-air circuit 42 is connected to the connecting piece 102.

The yarn draw-off pipe 20 is inserted from the back 36 of the mounting plate 30 through the centering bushing 3 and its bore 35 and reaches into bore 21 of cover 1. The yarn draw-off pipe 20 is here pressed by an elastic holding device 38 in the direction of the rotor cover (see FIGS. 4 and 5). The holding device 38 can be in form of a leaf spring which is screwed to the mounting plate 30 and is capable of being pivoted. It bears upon a collar 22 of the yarn draw-off pipe 20 and presses it in the direction of cover 1 as far as a stop 23 of the rotor cover 1 (see also FIG. 3). The transition between bore 21 and bore 16 of the cover 1 forms stop 23 for the yarn draw-off pipe 20. If a yarn draw-off nozzle not shown in FIG. 4 is designed so that it extends beyond bore 16 into bore 21 it constitutes the stop for the yarn draw-off pipe 20. The yarn draw-off pipe 20 is (not shown) introduced up to its stop 23 in FIG. 4.

As FIG. 4 clearly shows, the cover 1 can be detached from the mounting plate 30 without interference from the fiber draw-off pipe nor from the compressed-air connection. The compressed-air connection remains attached to the mounting plate via its connecting piece 102, as is also the case for the yarn draw-off pipe 20 via its seat (31, 35). The configuration of the mounting plate 30 according to the invention also makes it possible for the yarn draw-off pipe 20 to be removed from the mounting plate and to be replaced by a new one, for example, without having to remove cover 1 from mounting plate 30 for this purpose. A simple element in the form of a flat spring makes it possible to hold the yarn draw-off pipe on the mounting plate 30. This elastic holding device 38 also ensures that the yarn draw-off pipe is always pushed up to its stop 23 in cover 1. For the sake of clarity no cross-hatching was applied to most of the cut surfaces of FIG. 4.

The design of the cover according to the invention, with a seat for the yarn draw-off pipe that is especially advantageous if in the form of a centering bushing with a bore and the design according to the invention of the cover with a connecting piece for the compressed-air supply for a rotor cover are in principle independent from each other. If, however, a rotor cover is to be assembled with air connection it is of course especially advantageous to combine the two inventions.

We claim:

1. A cover for the spinbox of a rotor spinning machine, comprising:

a) a cover plate having a front side which has a fiber feeding fitting disposed thereon and which extends into the rotor during spinning, and having a back side;

b) a cover mounting plate for supporting said cover plate having a front side and a back side, said front side of said mounting plate cooperating with said back side of said cover plate;

c) a plurality of stops disposed between the back side of said cover plate and the front side of said mounting plate for supporting said cover plate on said mounting plate, said stops defining a first plane between said cover plate and said mounting plate;

d) a fitting in said cover plate for compressed air for rotor cleaning;

e) a fiber feeding channel disposed in said cover plate and connected to said fiber feeding fitting for feeding fibers to said rotor;

f) a compressed air channel disposed in said cover plate and connected to said compressed air fitting for receiving compressed air;

g) a sealing surface disposed on the back side of said cover plate at said compressed air fitting, said sealing surface defining a second plane substantially parallel to said first plane between said cover plate and said mounting plate so that a predetermined distance exist between said first plane and said second plane; and h) a compressed air connection in said mounting plate for pressing against said sealing surface for sealing contact therewith for a fluid connection therewith.

2. A cover as set forth in claim 1, wherein said second plane of said sealing surface is closer to the front side of said cover plate than said first plane of said stops.

3. A cover as set forth in claim 1, wherein said cover plate comprises a centering fitting with a centering bore on the back side of said cover plate for centering said cover plate on said mounting plate.

4. A cover as set forth in claim 3, wherein said centering fitting has a surface which lies in said second plane of said sealing surface.

5. A cover as set forth in claim 3, wherein said centering bore is part of an off set bore whose smaller diameter receives the end of a yarn draw-off pipe of said cover plate.

6. A cover as set forth in claim 1, wherein said distance between said second plane of said sealing surface and said first plane of said stops is such as to provide space between said cover plate and said mounting plate for said compressed air connection between said cover plate and said mounting plate.

7. A cover as set forth in claim 6, wherein said distance between said second plane of said sealing surface and said first plane of said stops is from three to five millimeters.

8. A cover as set forth in claim 1, wherein at least one of said stops is cylindrical.

9. A cover as set forth in claim 8, wherein at least one of said stops is provided with a bore for attachment of said cover.

10. A cover as set forth in claim 1, wherein said stops are made in the form of bridges or ribs integrally cast on said cover plate.

11. A cover as set forth in claim 1, wherein said mounting plate comprises an opening near the compressed air connection of said cover plate, said compressed air connection being inserted into said opening, said compressed air connecting being provided with a seal which interacts with said sealing surface of said cover plate.

12. A cover as set forth in claim 11, wherein said compressing air connection is removably attached to said mounting plate.

13. A cover as set forth inn claim 11, wherein said mounting plate comprises a centering bushing which interacts with a centering bore of said cover plate.

14. A cover as set forth in claim 13, wherein said centering bushing comprises a bore to receive a yarn draw-off pipe.

15. A cover as set forth in claim 11, wherein said mounting plate comprises at least one bore for the attachment of said cover plate.

16. A cover as set forth in claim 11, wherein said mounting plate is provided with a seat for a yarn draw-off pipe into which said yarn draw-off pipe is inserted and held from the back side of said mounting plate.

17. A cover as set forth in claim 16, wherein said yarn draw-off pipe extends through said seat into the back of said cover plate.

18. A cover as set forth in claim 16, wherein said seat is made in the form of a centering bushing for the cover plate and has a bore through which said yarn draw-off pipe extends into said cover plate.

19. A cover as set forth in claim 16, wherein said mounting plate comprises a holding device for the attachment of a yarn draw-off pipe in said seat.

20. A cover as set forth in claim 19, wherein said holding device exerts a force upon said yarn draw-off pipe in the axial direction of said seat so that said yarn draw-off pipe is held in the mounting plate so as to be capable of being shifted axially.

21. A cover plate for mounting on the front side of a mounting plate of the spinbox of a rotor spinning machine, said cover plate comprising:

a) a front side which has a fiber feeding fitting disposed thereon and which extends into the rotor during spinning, sand having a back side cooperating with the front side of the mounting plate;

b) a plurality of stops disposed between the back side of said cover plate and the front side of the mounting plate for supporting said cover plate on the mounting plate, said stops defining a first plate between said cover plate and the mounting plate;

c) a fitting in said cover plate for compressed air for rotor cleaning;

d) a fiber feeding channel disposed in said cover plate and connected to said fiber feeding fitting for feeding fibers to said rotor;

e) a compressed air channel disposed in said cover plate and connected to said compressed air fitting for receiving compressed air; and f) a sealing surface disposed on the back side of said cover plate at said compressed air fitting, said sealing surface defining a second plate substantially parallel to said first plane between said cover plate and the mounting plate so that a predetermined distance exists between said first plane and said second plane, said sealing surface for sealing contact with a compressed air connection in the mounting plate.

22. A cover plate as set forth in claim 21, wherein said second plane of said sealing surface is closer to the front side of said cover pate than said first plane of said stops.

23. A cover plate as set forth in claim 21, wherein said cover plate comprises a centering fitting with a centering bore on said back side for centering said cover plate on the mounting plate.

24. A cover plate as set forth in claim 23, wherein said centering fitting has a surface which lies in said second plane of said sealing surface.

25. A cover plate as set forth in claim 23, wherein said centering bore is part of an off-set bore whose smaller diameter receives the end of a yarn draw-off pipe of said cover plate.

26. A cover plate as set forth in claim 21, wherein said distance between said second plane of said sealing surface and said first plane of said stops is such so as to provide space between said cover plate and the mounting plate for said compressed air connection between said cover plate and the mounting plate.

27. A cover plate as set forth in claim 26, wherein said distance between said second plane of said sealing surface and said first plane of said stops is from three to five millimeters.

28. A cover plate as set forth in claim 21, wherein at least one of said stops is cylindrical.

29. A cover plate as set forth in claim 28, wherein at least one of said stops is provided with a bore for attachment of said cover.

30. A cover plate as set forth in claim 21, wherein said stops are made in the form of bridges or ribs integrally cast on said cover plate.

* * * * *